US006460447B1

(12) United States Patent
Meyers et al.

(10) Patent No.: US 6,460,447 B1
(45) Date of Patent: Oct. 8, 2002

(54) WEAPON AIMING

(76) Inventors: Brad E. Meyers, 2717 200th Ave. SE., Issaquah, WA (US) 96027; Mark Cameron, 7702 188th St. SE., Snohomish, WA (US) 98296

( * ) Notice: Subject to any disclaimer, the term of this patent is extended or adjusted under 35 U.S.C. 154(b) by 0 days.

(21) Appl. No.: 09/499,931

(22) Filed: Feb. 8, 2000

Related U.S. Application Data

(60) Provisional application No. 60/119,242, filed on Feb. 9, 1999, now abandoned.

(51) Int. Cl.[7] ..... F41G 3/14

(52) U.S. Cl. ..... 89/41.06; 89/41.19; 89/37.07; 89/40.01

(58) Field of Search ..... 89/41.06, 41.19, 89/41.22, 37.07, 40.01

(56) References Cited

U.S. PATENT DOCUMENTS 3,710,675 A * 1/1973 Asikainen ..... 89/41.06
4,214,372 A * 7/1980 Rusbach ..... 33/252
5,171,933 A * 12/1992 Eldering ..... 89/41.06
5,187,317 A * 2/1993 Pellarin et al. ..... 89/36.14
5,191,163 A * 3/1993 Wallwey et al. ..... 89/6
5,197,691 A * 3/1993 Amon et al. ..... 89/41.19
5,408,778 A * 4/1995 Goodwin et al. ..... 89/41.19
5,992,292 A * 11/1999 Ennenga ..... 89/41.22

FOREIGN PATENT DOCUMENTS

DE 2103328 * 8/1972 ..... 89/41.06

* cited by examiner

*Primary Examiner*—Stephen M. Johnson
(74) *Attorney, Agent, or Firm*—Dorsey & Whitney LLP

(57) ABSTRACT

An aiming system for a trajectory weapon such as a ground launcher, machine gun, mortar, or the like. The aiming system is attached to a conventional mount for the involved weapon. Also disclosed is a method of sighting in a weapon which employs the aiming system.

32 Claims, 9 Drawing Sheets

WEAPON AIMING

CROSS REFERENCE TO A RELATED APPLICATION

The present invention is related to provisional application No. 60/119,242 filed Feb. 9, 1999 now abandoned. The benefit of the filing date of the provisional application is claimed.

TECHNICAL FIELD OF THE INVENTION

In one aspect, the present invention relates to novel, improved aiming systems for trajectory weapons.

In another aspect, the present invention relates to novel, improved methods and apparatus for sighting (or zeroing in) weapons.

BACKGROUND OF THE INVENTION

The present invention is particularly concerned with weapons having a low to high trajectory including, but not limited to, machine guns, grenade launchers, rocket launchers, and mortars.

A variety of aiming devices and aiming device mounts have been developed for weapons of the character described above.

Zeroing (or sighting) a weapon equipped with conventionally mounted aiming devices typically involves firing the weapon, adjusting the sight, and repeating the firing/adjusting sequence. This process is time consuming, involves live ammunition, and is further disadvantageous in that the whole process has to be repeated each time a weapon is replaced or a barrel is swapped out.

Furthermore, conventional aiming devices—such as those available for mortars—are virtually useless in commonly occurring circumstances such as the hours of darkness.

Furthermore, in many conventional systems, the aiming device is mounted in a location where it is directly exposed to the recoil generated when the weapon is fired. This can result in the aiming device being moved out of adjustment to the extent that the accuracy of the weapon is significantly degraded.

In view of the foregoing, it will be apparent to the reader that there is a need for better aiming systems and better methods for sighting in trajectory weapons.

SUMMARY OF THE PRESENT INVENTION

These needs are met by the novel aiming systems and sighting in methods and apparatus disclosed herein.

The novel aiming systems of the present invention are advantageously designed for use with available and hereafter developed weapon mounts without significant modification of the mount. They are designed to interchangeably accommodate optical, laser, thermal, and other aiming devices as well as combinations of aiming devices. Precise aiming and the capability of achieving first round hits are provided, even under nighttime and other adverse conditions. The precise aiming and first round hit capabilities can be extended to the acquisition of multiple targets.

Barrels can be swapped out without disturbing the aiming device(s) that may be in use. This allows a firing mission to be continued without resighting the weapon.

As the aiming device systems of the present invention are divorced from the weapon, replacement of a particular weapon with one of a different kind is facilitated. Guide rails capable of supporting a variety of aiming devices are preferably employed, thus facilitating the substitution of one type of sight for another.

Interchangeable range scales are preferably employed in the aiming device systems of the present invention. Range scales for a particular type of weapon or ammunition are thereby readily provided. A related advantage of the aiming device mounts disclosed herein is that there is no need to rezero the weapon when switching from one type of ammunition to another; only the selection of the appropriate range scale is required.

The range scale is preferably illuminated with a low-level blue to green illumination device. Image intensified night vision devices have low sensitivity in that frequency range. Consequently, the illumination is advantageously the same whether the range scale is viewed with the naked eye or through a night vision device.

As mentioned above, a novel method of sighting in a trajectory weapon and the apparatus used in accomplishing this objective are disclosed herein. The sighting apparatus includes a mandrel, which encompasses a laser for projecting a dot onto a target. The mandrel is installed in the muzzle or bore of the weapon with the dot being placed on a target bullseye and the aiming device adjusted until it registers with a second indicator such as a cross-hair. This zeroes the weapon for a selected range, and the range scale on the aiming device mount is employed to select other ranges.

Sighting is accomplished easily and quickly and with comparatively inexpensive equipment. The necessity of firing the weapon is eliminated, and the weapon can be sighted with a degree of accuracy that virtually guarantees first round hits.

BRIEF DESCRIPTION OF THE DRAWINGS

FIG. 3 shows the details of two laser type aiming devices which can be employed in the FIG. 1 aiming system;

DETAILED DESCRIPTION OF THE INVENTION

Figure 1:
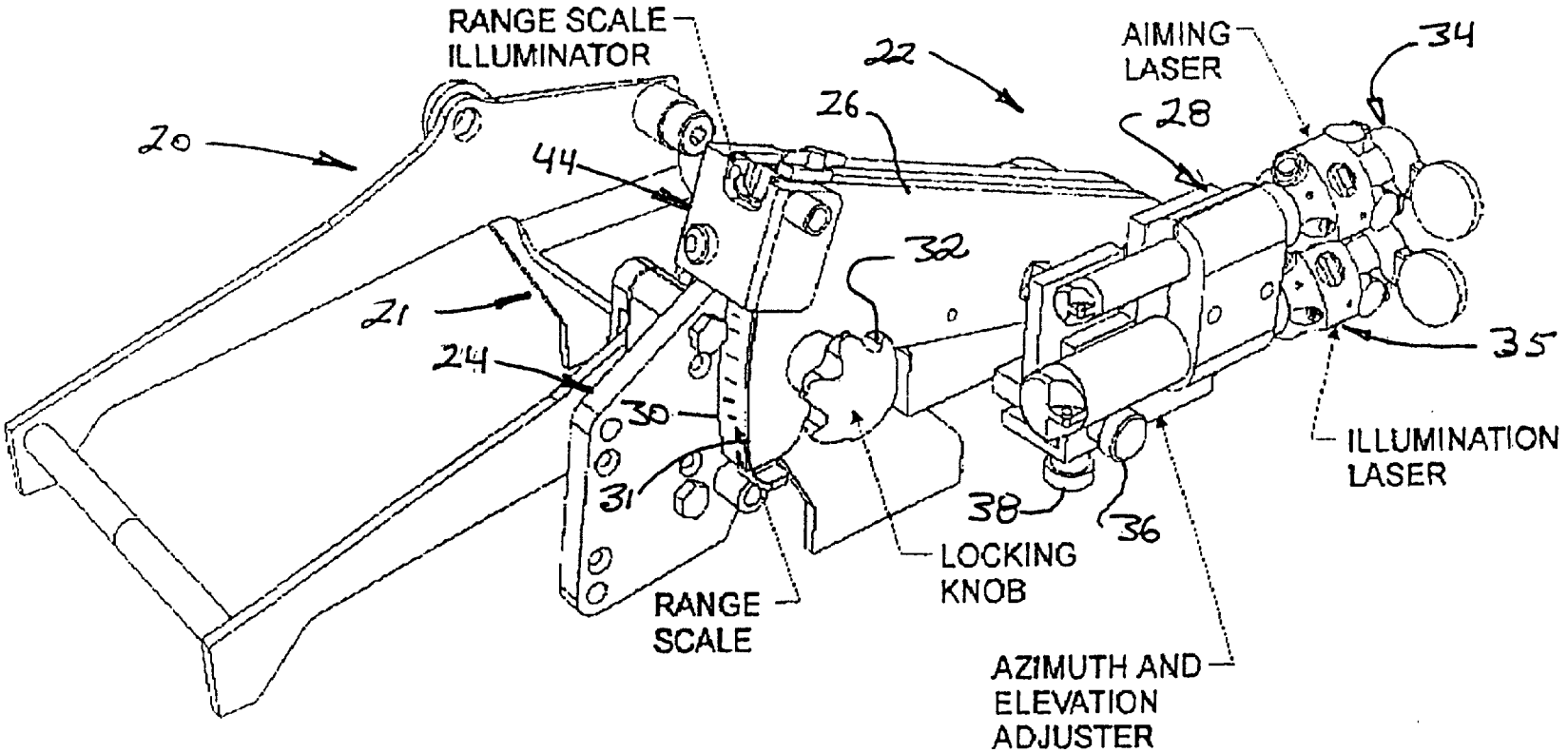
FIG. 1 is a perspective view of a weapons mount equipped with an aiming system embodying and constructed in accord with the present invention.

Referring now to the drawing, FIG. 1 depicts a conventional, MK-64 weapons mount 20 with a cradle 21 and, supported by the mount, a weapon aiming system 22 embodying and constructed in accord with the principles of the present invention. Weapon mount 20 is conventional except for minor modifications employed in attaching aiming system 22 to the weapon mount.

Figure 9:
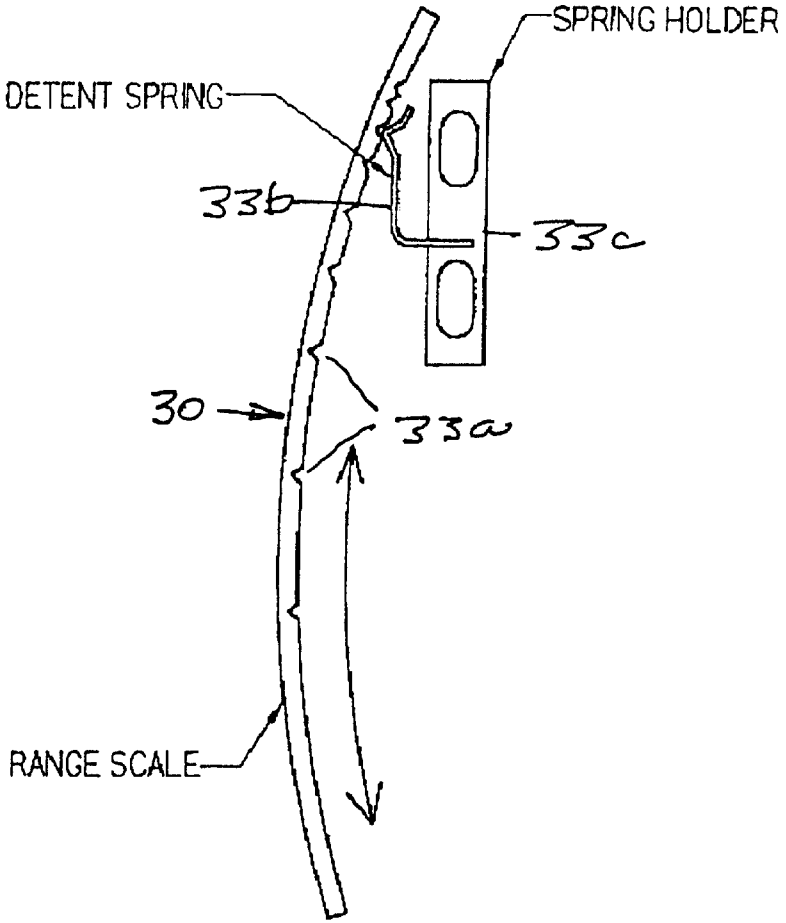
FIG. 9 is a view showing the details of a detent system, which facilitates the aiming of the weapon.
Figure 8:
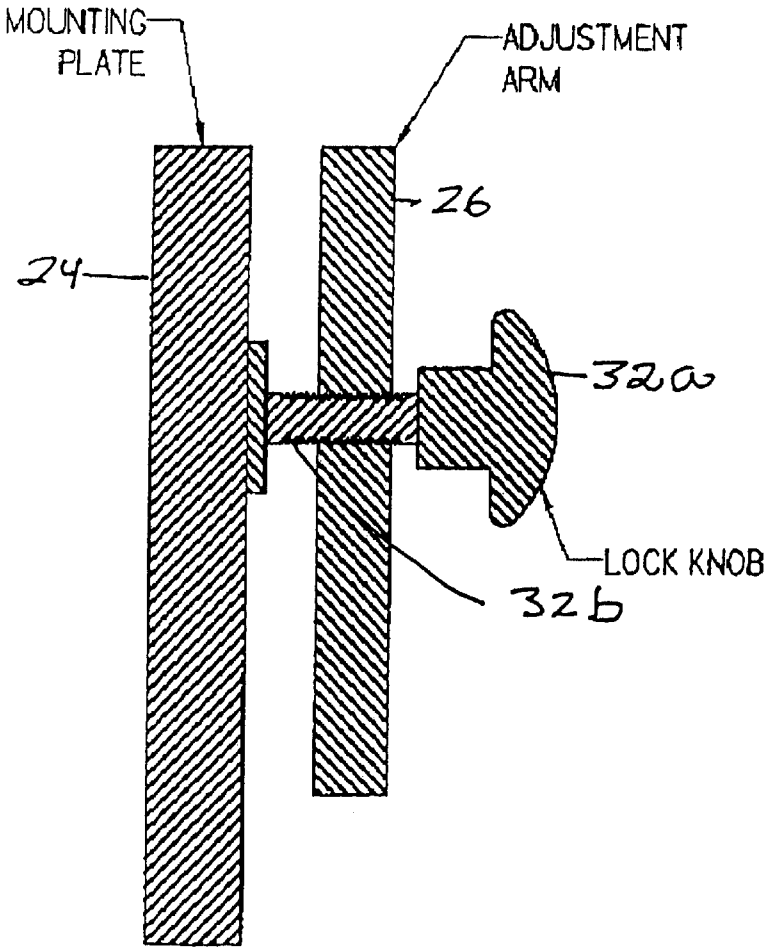
FIG. 8 is a sectional view showing the details of a mechanism employed to lock a sight supporting component of the aiming system in an attitude corresponding to a range selected by the weapon user.

The aiming system includes a stationary support plate 24 fixed to the weapon mount 20, a sight supporting arm 26 which is pivotable with respect to plate 24, and a sight supporting rail 28. An interchangeable range scale 30 is detachably fixed to the rear end 31 of pivotable sight supporting arm 26, and a knob 32*a* fixed to a shaft 32*b* (see FIG. 8) threaded through adjustment arm 26 and into contact with the support plate 24. The support plate 24 is provided to lock the pivotable sight supporting arm 26 in a position corresponding to the selected range. (see FIG. 8). Detents 33*a* engageable by a spring 33*b* attached to a stationary holder 33*c* (see FIG. 9) allow the gunner to easily find ranges for which detents are provided. The interchangeable range scale 30 allows a weapon supported in mount 20 to be interchanged and allows one to use range scales appropriate for different types of ammunition.

The illustrated embodiment of the invention employs two laser targeting-type devices respectively identified by reference characters 34 and 35. Laser 34 is employed to aim a weapon supported in mount 20 at a target. Laser 35 is employed to illuminate the target or, alternatively, to acquire a second, typically moving target. Knobs 36 and 38 are employed to adjust the azimuth and elevation of the laser devices 34 and 35 when the weapon supported by mount 20 is zeroed in as are internal adjustments (not shown) of the character disclosed in U.S. Pat. No. 5,036,517.

Figure 2:
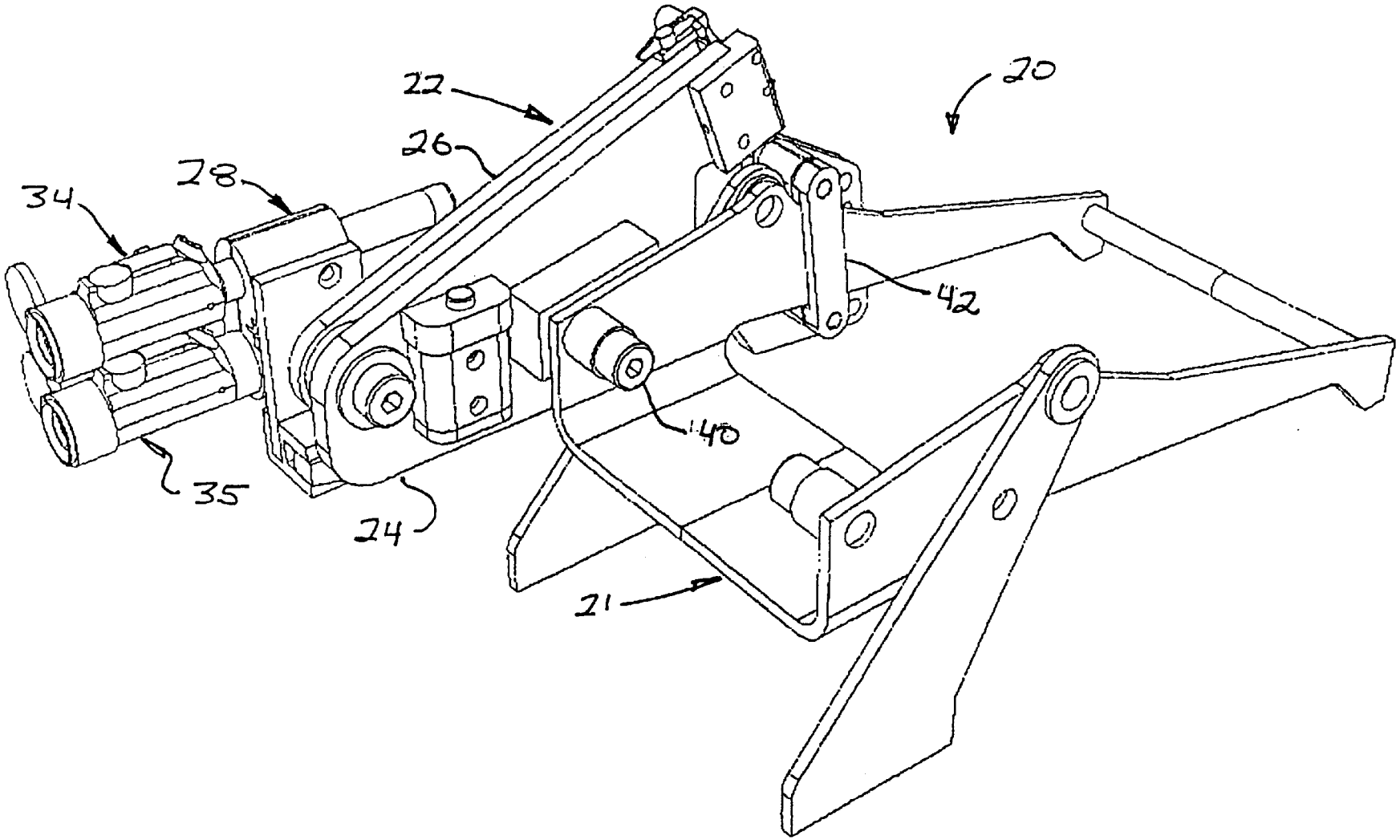
FIG. 2 is a second view of the weapons mount and aiming system of FIG. 1.
Figure 7:
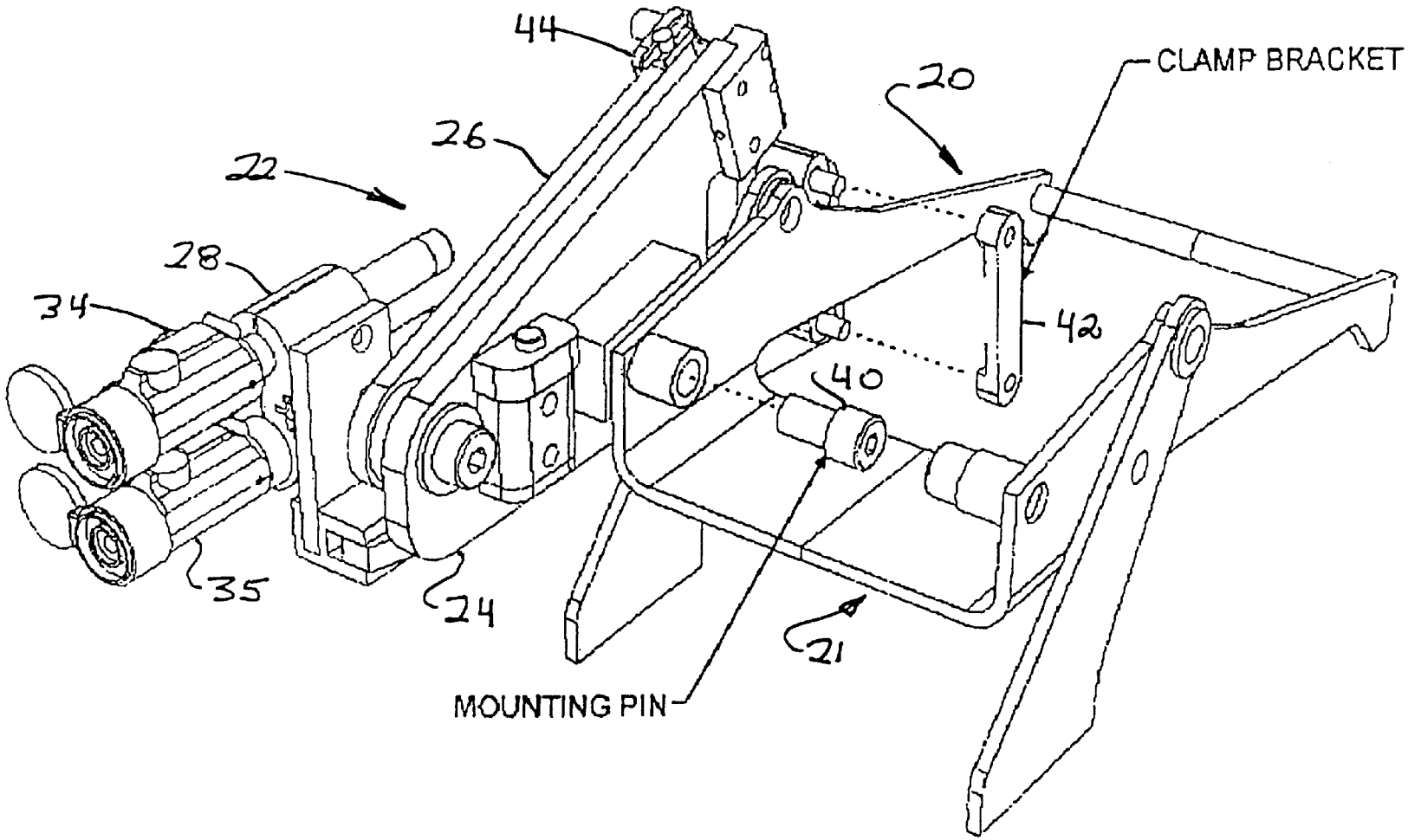
FIG. 7 is a perspective view showing the details of the weapons mount and an arrangement employed to secure the aiming system to the mount.

Turning now to FIG. 2, aiming system 22 is fixed to mount 20 by a pin 40 and a clamp bracket 42. These components are also shown in detail in FIG. 7.

Figure 3:
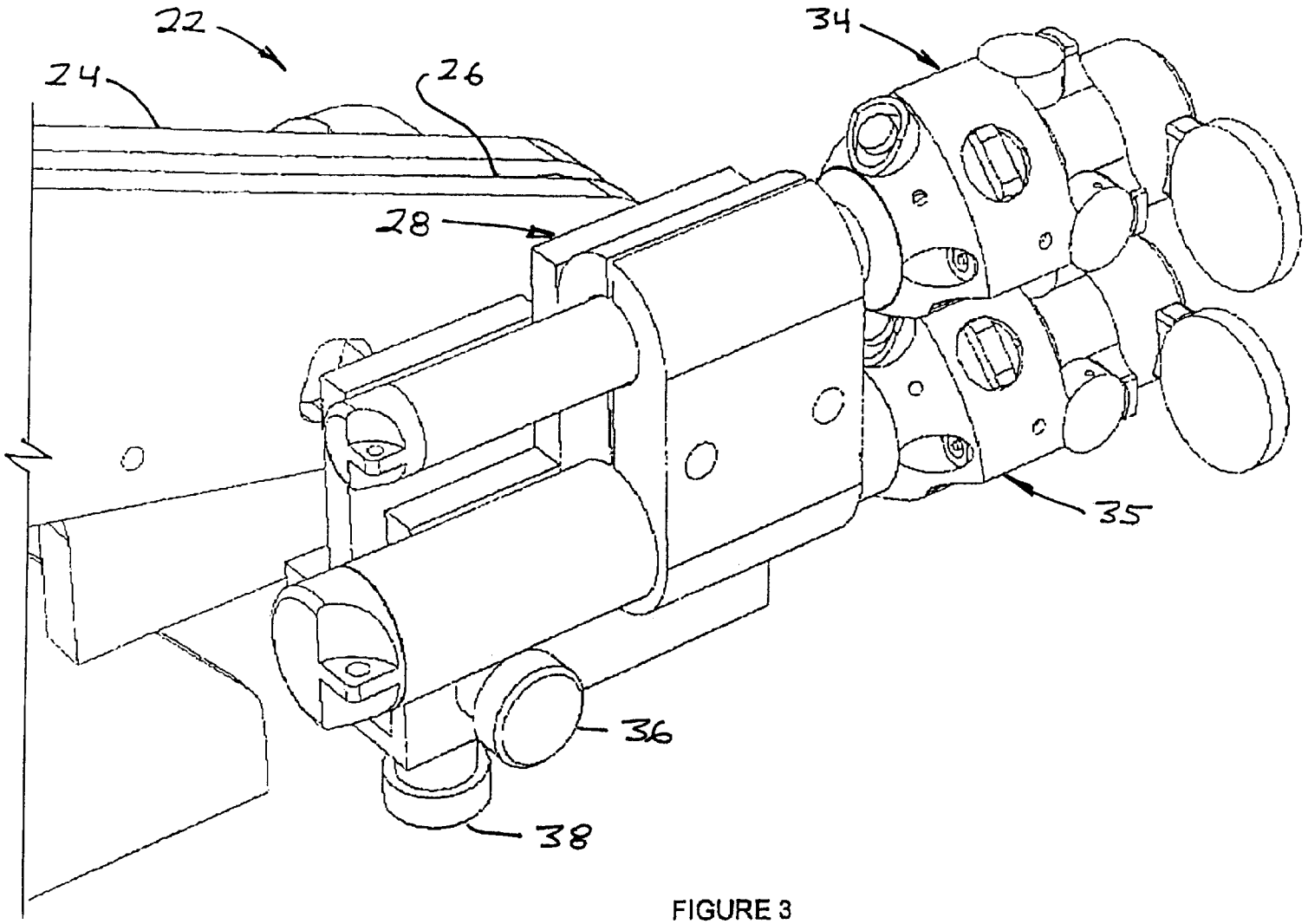
FIG. 3 is a fragment of FIG. 1 to an enlarged scale.

Lasers 34 and 35 and the mounting arrangement for those lasers are shown in more detail in FIG. 3. The particular lasers 34 and 35 shown in the drawing are respectively an IZLID-100p illuminator/designator and an IZLID200p illuminator/designator, both available from B. E. Meyers & Company of Redmond, Wash.

It is not required that these two laser type aiming devices be employed, and mounting rail is in fact configured to accommodate other types of aiming devices such as conventional optical sights, thermal imaging devices, etc.

Figure 4:
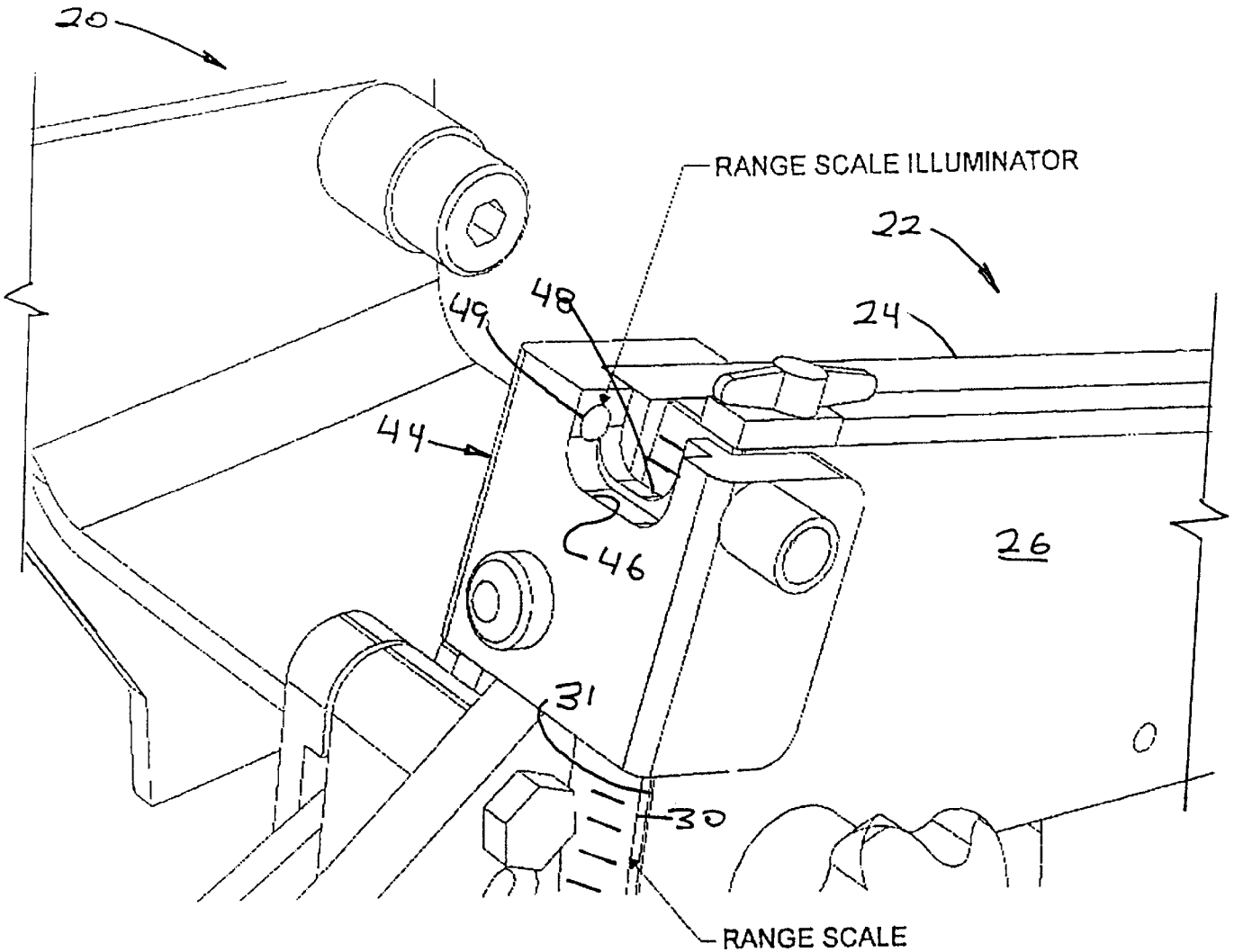
FIG. 4 is a fragment of FIG. 1 drawn to an enlarged scale and showing an arrangement for illuminating a range scale of the aiming system.

Turning now to FIG. 4, range scale 30 is preferably illuminated to facilitate the ranging of the weapon by a gunner. As shown in FIG. 4, a block 44 is fixed to the stationary component 24 of aiming system 22 at the rear end 31 of the stationary component. A U-shaped notch 46 in this plate provides an indicator 48 that is positioned opposite a mark on scale 30 to adjust aiming system 22 to a particular range. Mounted in block 44 at one side of notch 46 is alluded to range scale illuminator 49. A device capable of providing light in the green to blue range is preferred because the gunner may be employing night vision goggles in periods of darkness. The photomultipliers of night vision goggles are insensitive to light of the color just described. The consequent favorable result is that the level of illumination of range scale 30 will be the same irrespective of whether the scale is viewed through a night vision device or with the naked eye.

Figure 5:
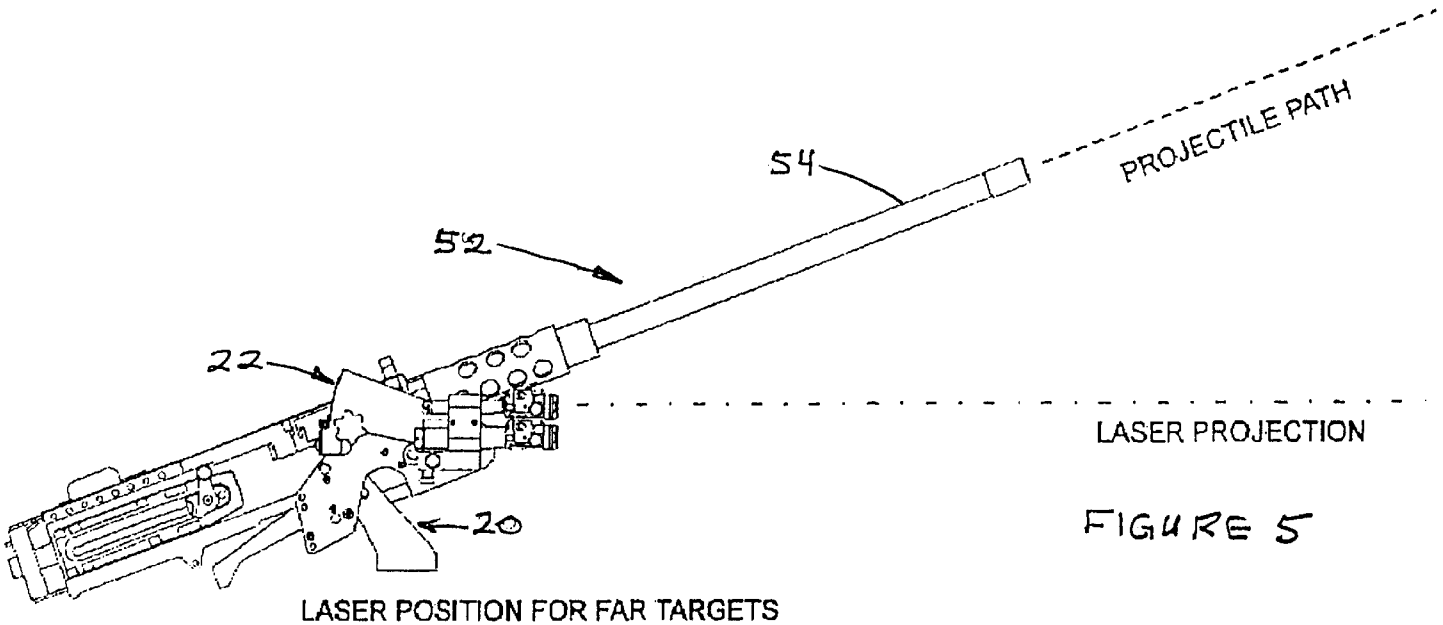
FIG. 5 is a view showing a heavy barrel machine gun mounted in the FIG. 1 weapons mount, the weapon being aimed in accord with the principles of the present invention to deliver a projectile to a distant target.
Figure 6:
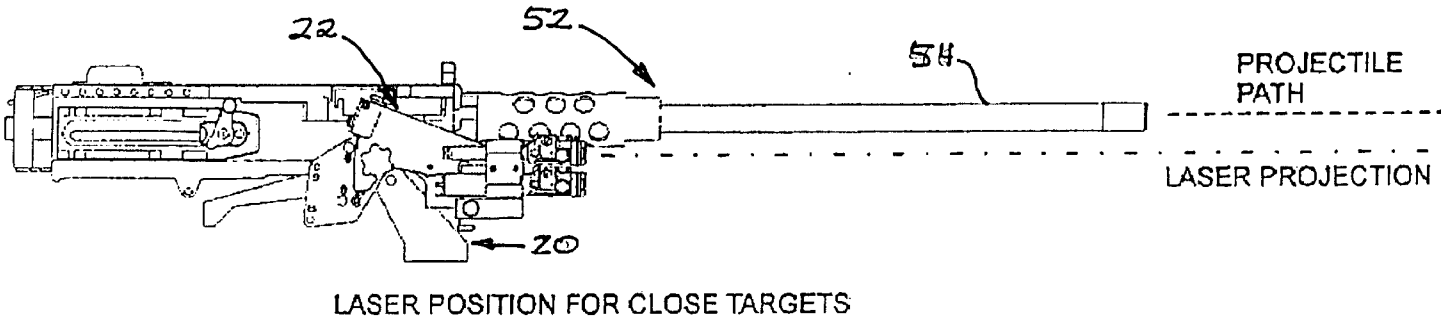
FIG. 6 is a view similar to FIG. 5 but showing the weapon aimed to deliver a projectile to a closer target.

The 50 caliber heavy barrel machine gun (HBMG) is one of the weapons that weapon mount cradle 21 is designed to accept. This HBMG is identified by reference character 52 in FIG. 5, which shows the barrel 54 of the weapon elevated to fire projectiles at a relatively distant target. FIG. 6 shows the same weapon with barrel 54 depressed to fire projectiles at a closer target.

Figure 10:
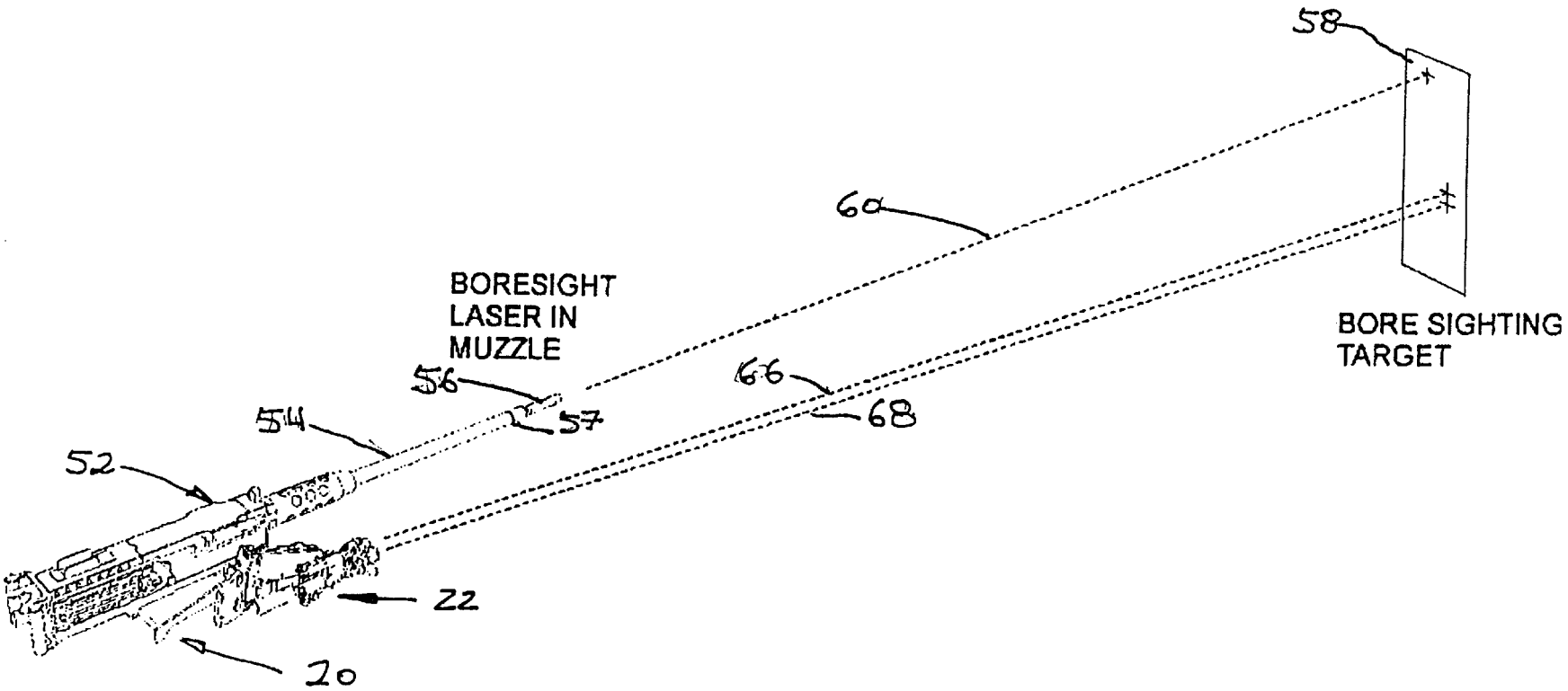
FIG. 10 shows pictorially how, a weapon is zeroed in according to the principles of the present invention.
Figure 11:
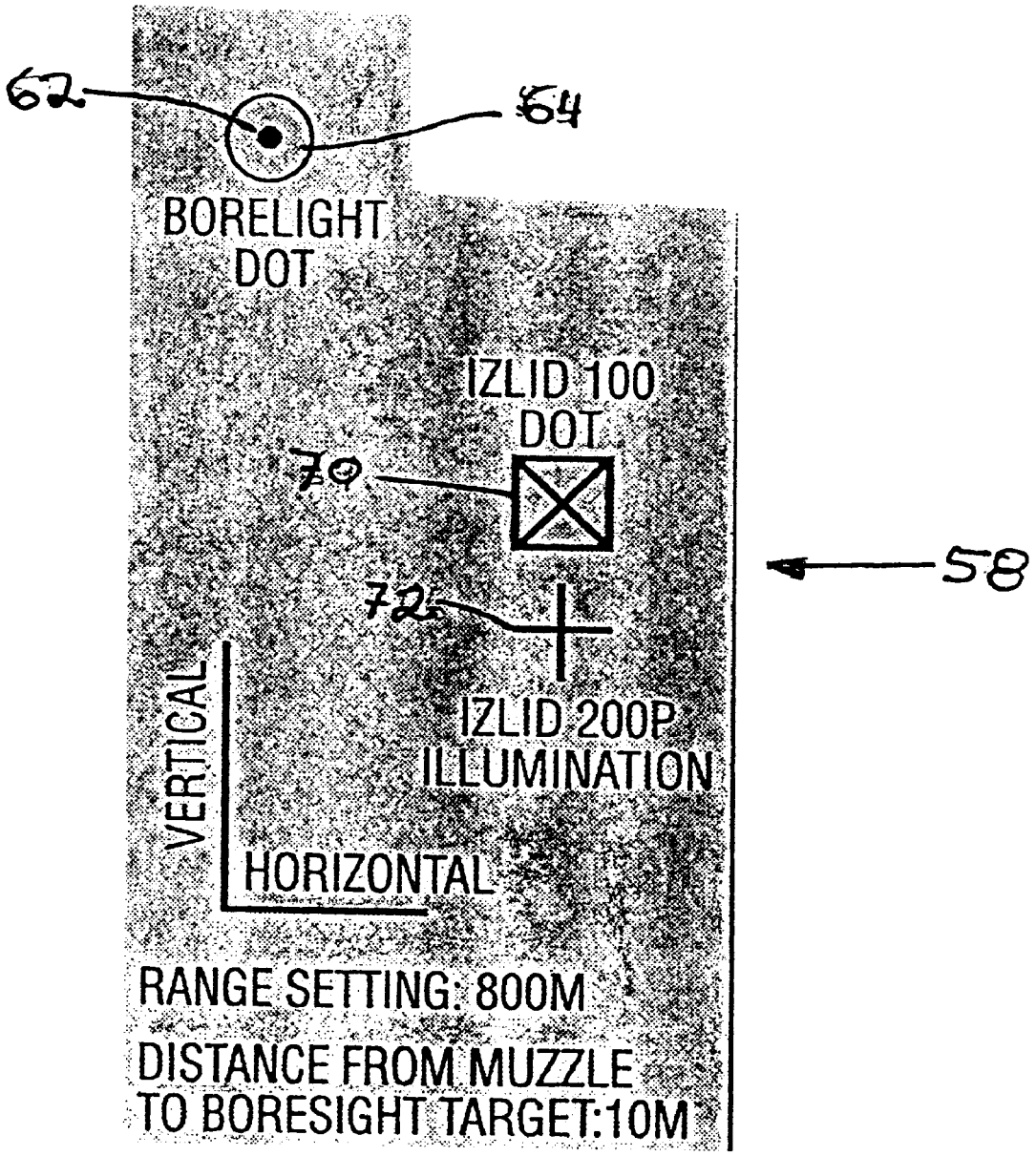
FIG. 11 is a front view of a target used in zeroing a weapon by the method described in FIG. 10.

It was pointed out above that one of the significant features of the present invention is a method of bore siting a weapon, such as the illustrated HBMG 52, with a degree of accuracy which allows for first round hits, an advantage of self-evident importance. Referring now to FIGS. 10 and 11, bore siting is accomplished with: (a) a laser-equipped mandrel 56 installed in the muzzle (or bore) 57 of the weapon being sighted in, such as the illustrated HBMG 52; and (b) target 58 which is set up at a distance of 10 meters from mandrel 56. The elevation and traverse of weapon 52 are adjusted until the beam 60 of energy projected from the laser in mandrel 56 appears as a dot 62 in the circle 64 of target 58. Lasers 34 and 35 are then adjusted with knobs 36 and 38 and the internal adjustments of the two lasers until the beams 66 and 68 from the two lasers appear as dots on the cross hairs 70 and 72 of target 58. At that juncture, weapon 52 is zeroed in for first round hits on targets at the range for which target 58 is configured, in this case 800 meters. Range scale 30 can subsequently be employed to target the weapon for other ranges.

As will be apparent to the reader, the just-described method for zeroing a weapon has the advantage that the firing of live ammunition is not required. Another significant advantage is that a range of the distance for which the weapon is being sighted is not required. In the exemplary method described above, for example, an area of only a little over 10 meters is needed to sight weapon 52 for a range of 800 meters. In contrast, to sight a weapon for this distance in the conventional manner requires an 800-meter range.

It will be apparent to the reader that the invention may be embodied in many forms in addition to those disclosed herein without departing from the spirit or essential characteristics of the invention. The present embodiment is therefore to be considered in all respects as illustrative and not restrictive. The scope of the invention is indicated by the appended claims rather than by the foregoing description and the drawings, and all changes which come within the meaning and range of equivalency of the claims are therefore intended to be embraced therein.

What is claimed is:

1. A combination of a weapon, a weapons mount adapted to support the weapon, and an aiming system for aiming the weapon at a desired target, said aiming system being attached directly to said weapons mount and not to the weapon, wherein the aiming system comprises interchangeable range scales, each of said range scales supporting a particular type of weapon and/or a particular type of ammunition.

2. A combination as defined in claim 1 which said aiming system comprises a laser.

3. A combination as defined in claim 1 in which said aiming system comprises a target illuminator assembled to said weapons mount.

4. A combination as defined in claim 3 in which said target illuminator comprises a laser.

5. A combination as defined in claim 4 wherein said laser is so incorporated in said aiming system as to make said laser capable of acquiring a second target.

6. A combination as defined in claim 1 Wherein the aiming system comprises a range scale and a device for so illuminating said range scale as to make said scale clearly visible when viewed through night vision equipment.

7. A combination as defined in claim 1 wherein said mount has a rail to which said aiming system can be mounted, said rail being capable of accepting other types of aiming systems and aiming devices.

8. Apparatus for aiming a weapon supported by a weapon mount, comprising:

a weapon;

a stationary member comprising a stationary plate adapted to be attached to the weapon mount;

a sight support pivotably coupled to the stationary member, the sight support comprising a support plate positioned substantially parallel with the stationary plate, wherein the support plate includes a range scale disposed thereon and wherein the stationary member comprises a range indicator projecting outwardly from the stationary plate and alignable with the range scale; and an aiming device operatively attached to the sight support and controllably positionable with respect to the sight support so that the aiming device can be directed at a desired location forward of the weapon.

9. The apparatus of claim 8 wherein the aiming device comprises a laser.

10. The apparatus of claim 8, further comprising:

an illumination device adapted to be coupled to the weapon and adapted to project an energy beam at a second location forward of the weapon, the energy beam being substantially aligned with an axis of a barrel of the weapon.

11. The apparatus of claim 8, further comprising:

an illumination device adapted to be coupled to the weapon and adapted to project an energy beam at a second location forward of the weapon, the energy beam being substantially aligned with an axis of a barrel of the weapon; and a target member having a first mark and a second mark, the target member being adapted to be positioned at a predetermined distance ahead of the weapon such that when the aiming device is directed at the first mark and the energy beam is directed as the second mark, the weapon will be properly sited for a predetermined range.

12. The apparatus of claim 11 wherein the target member further includes a third mark, the apparatus further comprising a second aiming device operatively attached to the sight support and controllably positionable with respect to the sight support so that the second aiming device can be directed at the third mark.

13. Apparatus for aiming a weapon supported by a weapon mount, comprising:

a weapon;

an illumination device adapted to be coupled to the weapon and adapted to project an energy beam at a first location forward of the weapon, the energy beam being substantially aligned with an axis of a barrel of the weapon;

an aiming device adapted to be operatively attached to the weapon mount and controllably positionable with respect to the weapon so that the aiming device can be directed at a second location forward of the weapon; and a target member having a first mark and a second mark, the target member being adapted to be positioned at a predetermined distance ahead of the weapon such that when the energy beam is directed at the first mark and the aiming device is directed at the second mark, the weapon will be properly sited for a predetermined range.

14. The apparatus of claim 13 wherein the illumination device comprises a laser.

15. The apparatus of claim 13 wherein the illumination device is adapted to be slideably engaged into an end of the barrel.

16. The apparatus of claim 13 wherein the aiming device comprises a laser.

17. The apparatus of claim 13 wherein the aiming device comprises a stationary member adapted to be attached to the weapon mount, and a sight support pivotably coupled to the stationary member.

18. The apparatus of claim 17 wherein the stationary member comprises a stationary plate attached to a side of the weapon mount, and the sight support comprises a support plate positioned substantially parallel with the stationary plate.

19. The apparatus of claim 18 wherein the support plate includes a range scale disposed thereon and wherein the stationary member comprises a range indicator projecting outwardly from the stationary plate and alignable with the range scale.

20. A combination of a weapon, a weapons mount adapted to support the weapon, and an aiming system for aiming the weapon at a desired target, said aiming system being attached directly to said weapons mount and not to the weapon, wherein the aiming system comprises a range scale and an illuminating device that makes said scale clearly visible when viewed through night vision equipment.

21. The combination as defined in claim 20 wherein said aiming system comprises a laser.

22. The combination as defined in claim 20 wherein said aiming system comprises a target illuminator assembled to said weapons mount.

23. The combination as defined in claim 22 wherein said target illuminator comprises a laser.

24. The combination as defined in claim 23 wherein said laser is so incorporated in said aiming system as to make said laser capable of acquiring a second target.

25. The combination as defined in claim 20 wherein the aiming system comprises interchangeable range scales, each of said range scales supporting a particular type of weapon and/or a particular type of ammunition.

26. The combination as defined in claim 20 in which said mount includes a rail to which said aiming system is mounted.

27. Apparatus for aiming a weapon supported by a weapon mount, comprising:

a weapon;

a stationary member adapted to be attached to the weapon mount;

a sight support pivotably coupled to the stationary member;

an aiming device operatively attached to the sight support and controllably positionable with respect to the sight support so that the aiming device can be directed at a desired location forward of the weapon;

an illumination device adapted to be coupled to the weapon and adapted to project an energy beam at a second location forward of the weapon, the energy beam being substantially aligned with an axis of a barrel of the weapon; and a target member having a first mark and a second mark, the target member being adapted to be positioned at a predetermined distance ahead of the weapon such that when the aiming device is directed at the first mark and the energy beam is directed as the second mark, the weapon will be properly sited for a predetermined range.

28. The apparatus of claim 27 wherein the aiming device comprises a laser.

29. The apparatus of claim 27 wherein the stationary member comprises a stationary plate attached to a side of the weapon mount, and the sight support comprises a support plate positioned substantially parallel with the stationary plate.

30. The apparatus of claim 29 wherein the support plate includes a range scale disposed thereon and wherein the stationary member comprises a range indicator projecting outwardly from the stationary plate and alignable with the range scale.

31. The apparatus of claim 27, further comprising:

an illumination device adapted to be coupled to the weapon and adapted to project an energy beam at a second location forward of the weapon, the energy beam being substantially aligned with an axis of a barrel of the weapon.

32. The apparatus of claim 27 wherein the target member further includes a third mark, the apparatus further comprising a second aiming device operatively attached to the sight support and controllably positionable with respect to the sight support so that the second aiming device can be directed at the third mark.

* * * * *